United States Patent [19]

Frey et al.

[11] Patent Number: 4,898,098

[45] Date of Patent: Feb. 6, 1990

[54] DEVICE FOR THE RAPID GENERATION OF A SMOKE SCREEN AND A METHOD FOR PREPARING A SMOKE CHARGE

[75] Inventors: Yvonne Frey, Münsingen; Jörg Kutzli, Höfen; Walter Rauber, Gwatt; Hans Schmocker, Thun; Markus Tobler, Seftigen, all of Switzerland

[73] Assignee: Schweizerische Eidgenossenschaft vertreten durch die Eidg. Munitionsfabrick Thun der Gruppe fÜr RÜstungsdienste, Thun, Switzerland

[21] Appl. No.: 274,244

[22] Filed: Nov. 21, 1988

[30] Foreign Application Priority Data

Dec. 24, 1987 [CH] Switzerland ..... 05058/87

[51] Int. Cl.[4] ..... F42B 13/44

[52] U.S. Cl. ..... 102/334

[58] Field of Search ..... 102/334

[56] References Cited

U.S. PATENT DOCUMENTS

| | | | |
|---|---|---|---|
| Re. 29,142 | 2/1977 | Papee et al. | 149/43 X |
| 4,474,715 | 10/1984 | Weber et al. | 102/334 X |
| 4,622,899 | 10/1986 | Weber | 102/334 X |
| 4,651,648 | 3/1987 | Alon | 102/334 X |
| 4,704,966 | 11/1987 | Sellman et al. | 102/334 X |

FOREIGN PATENT DOCUMENTS

| | | | |
|---|---|---|---|
| 1913790 | 10/1970 | Fed. Rep. of Germany | 102/334 |
| 037053A1 | 5/1982 | Fed. Rep. of Germany . | |
| 1131221 | 2/1957 | France . | |
| 2162621A | 2/1986 | United Kingdom . | |

*Primary Examiner*—Peter A. Nelson

*Attorney, Agent, or Firm*—Armstrong, Nikaido, Marmelstein, Kubovcik, & Murray

[57] ABSTRACT

For generation of smoke screens for civilian and military applications, briquetted, combustible masses are used, which, by means of scattering charges, are spread in a buckshot-like manner. Smoke charges serve mostly toxic substances which, at least when failing to burn or when only partly burning, constitute an environmental hazard.

According to the invention, there is provided a device consisting of nontoxic, hygroscopic smoke charges fully encapsulated in a moisture-impervious ignition layer. An ammunition body comprises smoke charges of differing sizes and geometries, and facilitates the ground-covering laying of smoke screens over large target areas.

A preferred manufacturing method for the smoke charges and the ignition layer is described.

21 Claims, 1 Drawing Sheet

Figure 1:
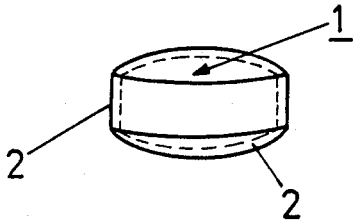

DEVICE FOR THE RAPID GENERATION OF A SMOKE SCREEN AND A METHOD FOR PREPARING A SMOKE CHARGE

The present invention relates to a device for generation of a smoke screen in a given target area wherein a plurality of briquetted smoke charges is accommodated in a container and is simultaneously ignitable and spreadable by a scattering charge, and wherein the smoke charges contain at least one metal oxide and at least one oxygen carrier and/or one halogen carrier. The invention further relates to a method for preparing these smoke charges.

Methods and devices for generating smoke screens for civilian and military applications are known (e.g. DE-OS No. 1 913 790), in which briquetted, combustible masses are spread over a target area in a buckshot-like manner with the aid of a scattering charge.

As smoke charge serves, e.g., red phosphor with an oxygen carrier (DE-OS No. 2 048 583) or metal/metal oxides with halogen carriers (DE-OS No. 3 037 053).

Especially during military training operations it was seen that combustion reliability of most ignition charges was insufficient and that, due to their toxicity, these charges, during combustion and/or when failing to burn, constitute a source of danger to humans and animals.

It is thus one of the objects of the invention to provide a device for generation of smoke screens which rapidly produces a sufficiently dense, ground-covering smoke screen, and the smoke charges of which burn with high reliability and without endangering the environment.

According to the invention, this is achieved by encapsulating the separate smoke charges on all sides in a hydrophobic ignition layer.

The ignition layer, recited in the claim, is impervious to moisture, i.e., smoke charges encapsulated in this layer resist moisture of the kind prevailing under field conditions, for example during rainy weather, on wet grass, etc. This imperviousness to moisture enormously increases the combustion reliability of the smoke charges.

A further object of the invention is the provision of a manufacturing method ensuring economic and safe preparation of environment-friendly smoke charges.

According to the invention, this is achieved by providing a first step of mixing, and subsequently drying, a reaction mixture consisting of ammonium chloride and zinc oxide in a total quantity of 70 to 90 kg, a second step of admixing to said reaction mixture ammonium perchlorate, polyvinyl chloride and zinc oxide, the total quantity being 8 to 12 kg, admixing taking place in a mixing tumbler, a third step of admixing, in a mechanical mixer at low speed, a binder in the form of nitrocellulose and acetone, a fourth step of predrying the still moist mixture on a plane surface, subsequently granulating and finish-drying it in vacuum for 1.5 to 2.5 hrs at 50° C., to 65° C., and a fifth step of briquetting said mixture in molds.

The moisture-impervious ignition layer performs a double function: It ensures rapid, peripheral ignition of the separate smoke charges by the scattering charge and, beyond that, constitutes a protective layer for the hygroscopic mixtures of the smoke charges.

The spherical design according to claim 2 increases the surface area of the ignition layer and thus additionally improves ignition reliability. Ballistically, too, this shape is favorable.

An advantageous mixture for the smoke charges is described in claim 3. It has no toxic materials, so that both the smoke generated thereby and any possible combustion residue are nontoxic. The following are suitable as organic binders: acryl resins, halogenated hydrocarbons, condensed polyamides, synthetic rubber, vinylether polymers.

Nitrocellulose, mentioned in claim 4, affects the ignition behavior of the device and controls combustion duration.

Collodion cotton according to claim 5 has been found very advantageous.

A further improvement is achieved by guncotton, see claim 6.

The mixtures specified in claims 7 to 9 constitute preferred embodiments of the smoke charges.

The organic binders listed in claims 8 and 9 are preferably higher hydrocarbons, natural proteins, polyglycols, polysaccharides.

The ignition layers according to claims 10, 11, 13 and 14 have the advantage of nontoxicity.

While the ignition layer according to claim 12 has given good results, it is slightly toxic in the nonignited state, due to its red-lead content.

The particle size indicated in claim 15 has been seen to be very advantageous under field conditions.

The method according to claim 16 is very economical and safe.

The ignition-layer mass prepared according to claim 17 is equally easy to handle and process.

The ignition layer according to claim 18, handled according to claim 19, is easily applied on the smoke charges in the desired thickness.

It is good practice to design the device as an ammunition body, comp. claim 20.

It was shown that by filling the ammunition body with smoke charges of differing dimensions (claim 21) taking into account their different flying behavior and combustion velocities, smoke-screen formation can be adapted to all forseeable tactical requirements.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 2:
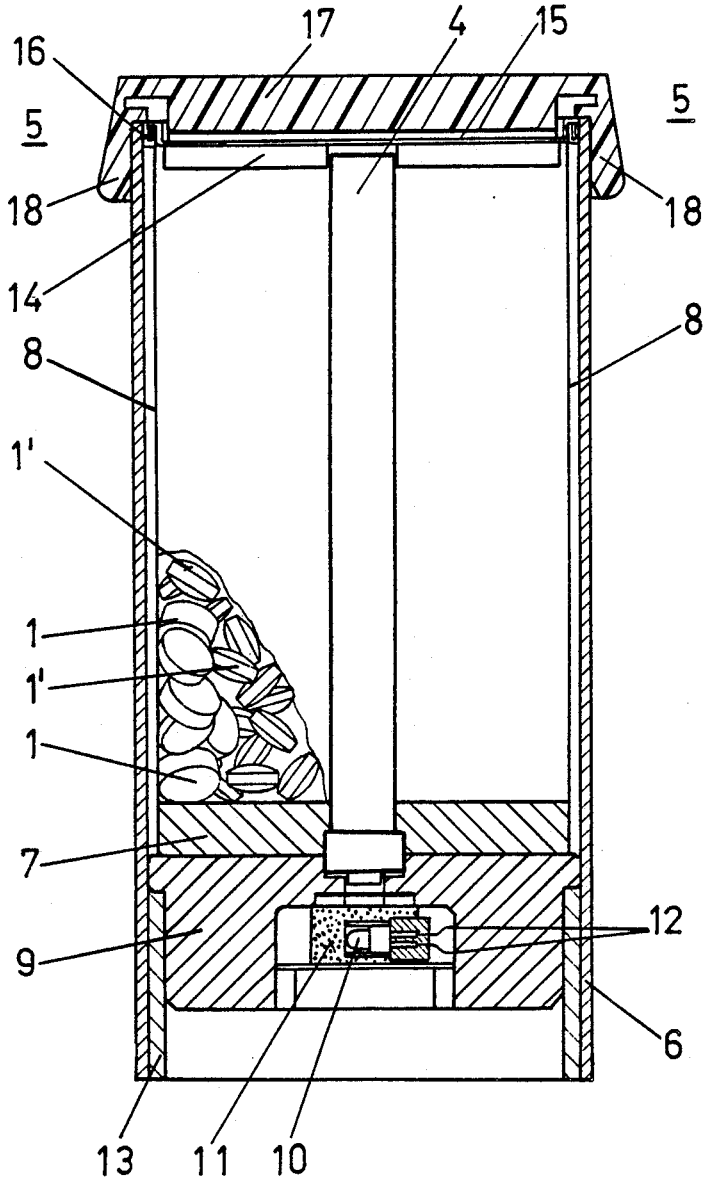

IN THE DRAWINGS FIG. 1 illustrates the characteristic design of a smoke charge with ignition layer, and FIG. 2 shows an ammunition body with scattering charge for use on vehicles.

Numeral 1 in FIG. 1 designates the smoke charge 1. The latter is fully encapsulated in an ignition layer 2.

The smoke charge 1 consists of a mixture of 12.5 wt.-% ammonium chloride, 31.7 wt.-% zinc oxide, 36.1 wt.-% ammonium perchlorate, 17.7 wt.-% polyvinyl chloride as well as 2.0 wt.-% organic binders. The organic binders consist of 5 wt.-% paraffin and 95 wt.-% nitrocellulose in the form of collodion cotton.

This smoke charge 1 is encapsulated in an ignition layer 2 consisting of a mixture of 15 to 35 wt.-% boron, 5 to 25 wt.-% silicon powder, 50 to 70 wt.-% manganese dioxide and 1 to 5 wt.-% organic binders which are admixed during the coating process. Particle size of the silicon powder admixed is about 25 μm.

This arrangement has the great advantage of moisture imperviousness. It provides easy ignitability, is realiable and rapid in the formulation of a dense, ground-covering smoke screen and ensures total combustion of the charges.

An ammunition body 5 (FIG. 2) contains a plurality of smoke charges 1 and 1', which are encapsulated in an above-described ignition layer 2. The interstices facilitate ignition of the separate pill - or spherical-shaped smoke charges 1,1'. The ammunition body 5 consists essentially of a tubular housing 6 in which is inserted a base plate 7 having a jacket 8. In an ignition flange 9 is located a per se known electric detonator 10 with a primer charge 11, both of which are adapted to act on a scattering charge 4.

This arrangement is ignited by a source of electric current, not shown, applied to the ignition leads 12. The ignition flange 9 is held in position by a pressed-in base ring 13. In the upper portion of the jacket 8 a cover plate 14 is inserted which, with the aid of a cover foil 15 and a folded seam 16, hermetically close the jacket 8. For protection, a lid 17, made of polyvinyl chloride and having a clamp flange 18, is slipped over the end of housing 6.

In the embodiment shown, the smoke charges 1 have a diameter of 13 mm and a height of 8 mm, with a radius of the spherical segment of 9.5 mm. The smoke charges 1' have a diameter of 10 mm, a height of 13 mm and a segment radius of 7.5 mm.

Such ammunition bodies are used on vehicles, in particular armored vehicles, permitting them to effectively smoke-screen their areas of deployment.

With the arrangement according to the invention flight distances of 70±20 m are covered without problems. Angle of elevation is about 45°, the scattering circle has a diameter of 40–50 m, and smoke-screen persistence per shot is 30–60 sec.

The differing dimensions of the smoke charges result in differing combustion times and differing aerodynamic resistances, so that by appropriate selection of size and form any target area within wide limits can be covered by a smoke screen.

It is obviously possible to also produce ammunition bodies of different designs, e.g., such as are suitable for use as missiles, projectiles, bombs, etc.

Technical conditions for production of the devices are easily controlled. By dry premixing, larger quantities are prepared in a mechanical mixer, and are wet-mixed using a liquid binder such as nitrocellulose and acetone, are subsequently granulated in a predried state and then finish-dried under vacuum, so that they can be pressed in molds.

The preferably spherical smoke charges with diameters between 10 and 15 mm and total heights of up to 15 mm are provided by means of a dish granulator, wherein they are coated with the viscous mixture of the ignition layer and are granulated until the ratio: ignition layer to smoke charge is about 1:10.

The device according to the invention, as well as the method can be optionally varied to be adapted to different requirements. Envisaged are also large smoke charges produced by the same method steps, as well as charges for small-calibre ammunition (from 4.5 cm calibre and up).

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for generation of a smoke screen in a given target area, wherein a plurality of briquetted smoke charges is accommodated in a container and is simultaneously ignitable and spreadable by a scattering charge, and wherein said smoke charges contain at least one metal oxide and at least one oxygen carrier and/or one halogen carrier, characterized in that the separate smoke charges are arranged randomly and are encapsulated on all sides in a hydrophobic ignition layer.

2. The device as claimed in claim 1, characterized in that said smoke charges with their ignition layer have a spherical shape.

3. The device as claimed in claim 1, characterized in that said smoke charges consist of a mixture of 5 to 25 wt.-% ammonium chloride, 20 to 50 wt.-% zinc oxide, 25 to 45 wt.-% ammonium perchlorate, 4 to 25 wt.-% polyvinyl chloride as well as of 1 to 10 wt.-% organic binders.

4. The device as claimed in claim 3, characterized in that said organic binders of said smoke charges at least partly contain nitro-cellulose.

5. The device as claimed in claim 4, characterized in that said nitrocellulose is collodion cotton.

6. The device as claimed in claim 4, characterized in that said nitrocellulose is guncotton.

7. The device as claimed in claim 4, characterized in that said nitrocellulose consists of a mixture of collodion cotton and guncotton.

8. The device as claimed in claim 4, characterized in that the share of said nitrocellulose amounts to 10 to 100 wt.-% of said binder.

9. The device as claimed in claim 1, characterized in that said smoke charges consist of a mixture of 13 wt.-% ammonium chloride, 31 wt.-% zinc oxide, 34 wt.-% ammonium perchlorate, 17 wt.-% polyvinyl chloride and 5 wt.-% organic binder.

10. The device as claimed in claim 1, characterized in that said smoke charges consist of a mixture of 41 wt.-% zinc oxide, 35 wt.-% ammonium perchlorate, 15 wt.-% polyvinyl chloride and 9 wt.-% organic binder.

11. The device as claimed in claim 1, characterized in that said smoke charges consist of a mixture of 12 wt.-% ammonium chloride, 39 wt.-% zinc oxide, 28 wt.-% ammonium perchlorate, 14 wt.-% polyvinyl chloride and 7 wt.-% binder.

12. The device as claimed in claim 1, characterized in that said ignition layer consists of a mixture of 30 to 40 wt.-% lead chromate, 35 to 45 wt.-% red led, 20 to 30 wt.-% silicon powder and 1 to 5% organic binder.

13. The device as claimed in claim 1, characterized in that said ignition layer consists of a mixture of 25 to 35 wt.-% boron, 5 to 15 wt.-% silicon powder, 35 to 45 wt.-% strontium peroxide, 15 to 25 wt.-% iron (III) oxide and 1 to 5 wt.-% organic binder.

14. The device as claimed in claim 1, characterized in that said ignition layer consists of a mixture of 15 to 35 wt.-% boron, 5 to 25 wt.-% silicon powder, 50 to 70 wt.-% manganese oxide and 1 to 5 wt.-% organic binder.

15. The device as claimed in claim 12, characterized in that said silicon power has a particle size of 10 to 80 μm.

16. A method for preparing a smoke charge according to claim 1 or any one of claims 3 to 8, characterized in that it comprises a first step of mixing, and subsequently drying, a reaction mixture consisting of ammonium chloride and zinc oxide in a total quantity of 70 to 90 kg, a second step of admixing to said reaction mixture ammonium perchlorate, polyvinyl chloride and zinc oxide, the total quantity being 8 to 12 kg, admixing taking place in a mixing tumbler, a third step of admixing, in a mechanical mixer at low speed, a binder in the form of nitrocellulose and acetone, a fourth step of predrying the still moist mixture on a plane surface, subsequently granulating and finish-drying it in vacuum for 1.5 to 2.5 hrs. at 50° C. to 65° C., and a fifth step of briquetting said mixture in molds.

17. A method for preparing a smoke charge as claimed in claim 1 or in any one of claims 9 to 11, characterized in that it comprises a first step of mixing, and subsequently drying, a reaction mixture consisting of ammonium chloride and zinc oxide in a total quantity of 70 to 90 kg, a second step of admixing to said reaction mixture ammonium perchlorate, polyvinyl chloride, zinc oxide and a binder, the total quantity being 45 to 55 kg and being admixed in a kneading machine and subsequently being granulated in a fluidized-bed process, and a third and last step of briquetting said mixture in forms.

18. A method for preparing an ignition layer as claimed in claim 1 or in any one of claims 12 to 14, characterized in that the components mixed in the dry state are admixed to an organic adhesive and an organic solvent.

19. A method for preparing smoke charges as claimed in claim 1, characterized in that, after briquetting, said smoke charges are coated in a dish granulator at room temperature with the liquid ignition layer dispersed within a liquid binder, the weight ratio between smoke charge and ignition layer being 15:1 to 8:1.

20. The device as claimed in claim 1, characterized in that said device has the form of an ammunition body.

21. The device as claimed in claim 20, characterized in that in said ammunition body there are provided smoke charges of different dimensions.

* * * * *